US006692080B1

(12) United States Patent
Bullard

(10) Patent No.: US 6,692,080 B1
(45) Date of Patent: Feb. 17, 2004

(54) SPRING-EDGE FURNITURE CONSTRUCTION

(75) Inventor: Larry Bullard, Winston-Salem, NC (US)

(73) Assignee: L & P Property Management Company, South Gate, CA (US)

( * ) Notice: Subject to any disclaimer, the term of this patent is extended or adjusted under 35 U.S.C. 154(b) by 0 days.

(21) Appl. No.: 10/268,264

(22) Filed: Oct. 10, 2002

Related U.S. Application Data

(63) Continuation-in-part of application No. 10/224,958, filed on Aug. 21, 2002.

(51) Int. Cl.[7] ..... A47C 7/34

(52) U.S. Cl. ..... 297/452.5; 297/452.51; 5/721

(58) Field of Search ..... 297/452.5, 452.51; 267/97, 101, 105, 96; 5/721, 727

(56) References Cited

U.S. PATENT DOCUMENTS 3,111,690 A * 11/1963 Tarlow ..... 5/721
3,428,304 A * 2/1969 Rowe ..... 267/97
3,765,038 A * 10/1973 Curtis ..... 297/452.51
4,476,595 A * 10/1984 Ikeda ..... 5/721
5,370,373 A * 12/1994 Bruner et al. ..... 267/97
5,570,874 A * 11/1996 Tornero ..... 297/452.5
6,065,809 A * 5/2000 Hoger ..... 297/452.5 X
6,082,825 A * 7/2000 Simon ..... 297/452.5
6,367,881 B1 4/2002 Bullard et al. ..... 297/452.5

* cited by examiner

*Primary Examiner*—Anthony D. Barfield
(74) *Attorney, Agent, or Firm*—Shook, Hardy & Bacon L.L.P.

(57) ABSTRACT

A novel support for use with furniture having a spring-edge is provided that includes a coil assembly. The coil assembly is typically square or rectangular with top and bottom surfaces and a front edge that faces the front of the furniture piece. A bridge is secured to the top surface of the coil assembly to provide support for the spring-edge. The bridge extends outwardly away from the front edge of the coil assembly and is supported in the same plane as the top surface of the coil assembly by a series of wires. The wire supports terminate at and hold a stiffening member in place that forms the upper portion of the spring-edge. The stiffening member is used to attach a series of front springs to the bridge. These springs are held in place on their lower end by the frame of the piece of furniture.

10 Claims, 5 Drawing Sheets

FIG. 5.
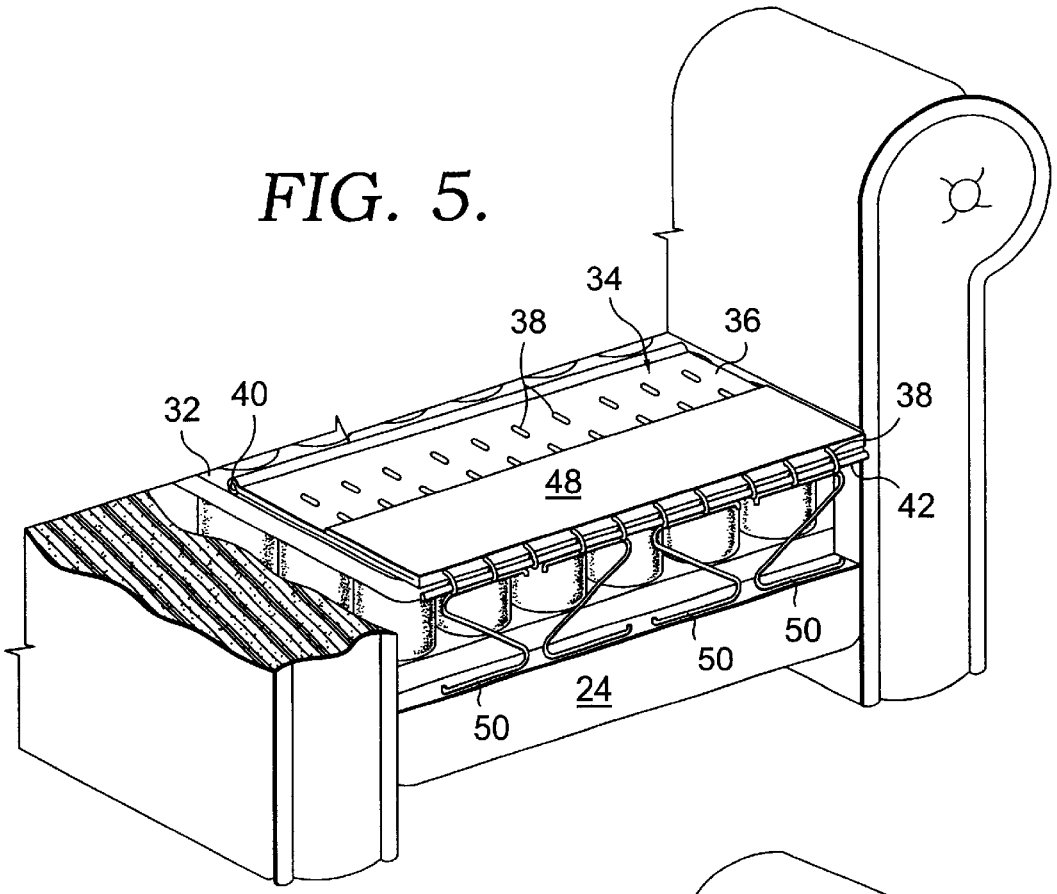
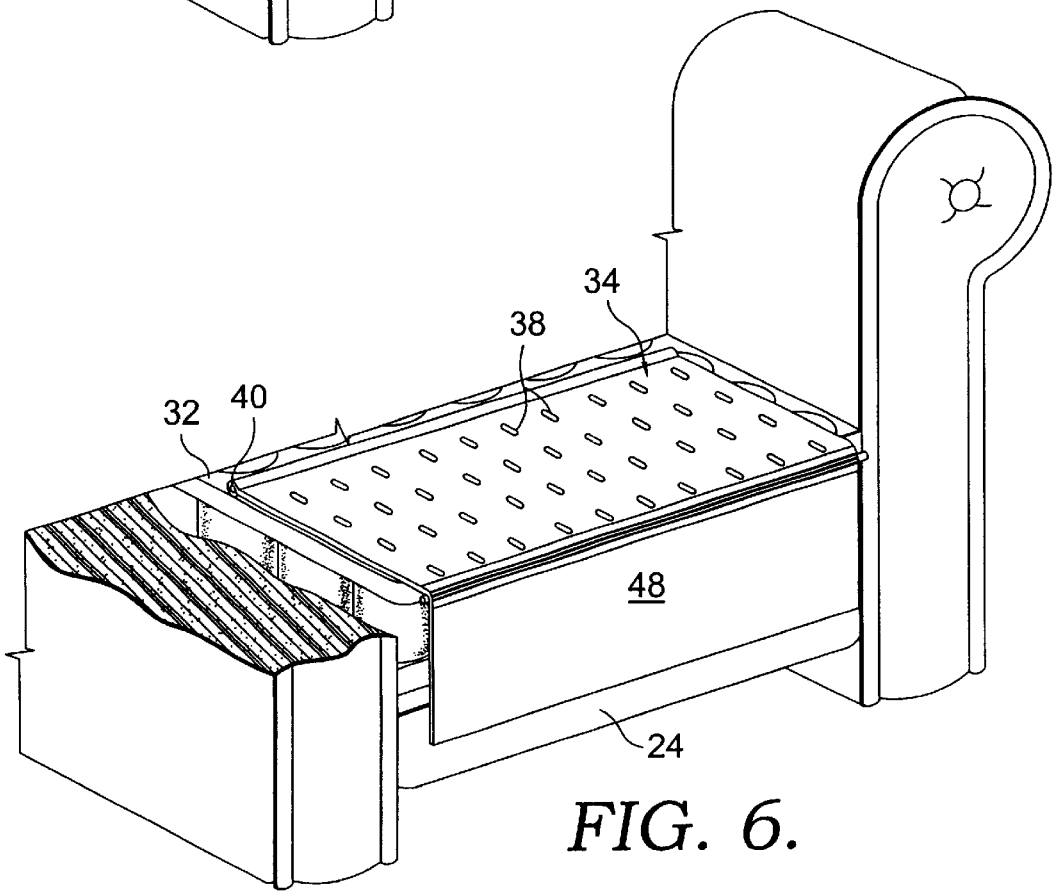
FIG. 6.

SPRING-EDGE FURNITURE CONSTRUCTION

CROSS-REFERENCE TO RELATED APPLICATIONS

This application is a continuation-in-part of application Ser. No. 10/224,958, filed Aug. 21, 2002.

STATEMENT REGARDING FEDERALLY SPONSORED RESEARCH OR DEVELOPMENT

None

TECHNICAL FIELD

The present invention relates generally to furniture components and, more particularly to a spring-edge construction for a chair, sofa, or similar seating construction.

BACKGROUND OF THE INVENTION

Sofas, loveseats, and chairs are well-known seating components and are found in virtually every home. These seating components typically use a support assembly that includes a number of spring coils. These spring coils are held between a base of some type and the cushion of the piece of furniture and provide a resilient support for the cushion.

The front edge of these seating components is typically either a "hard-edge" construction or a "spring-edge" construction. A hard-edge construction example is illustrated in FIG. 1. FIG. 1 shows a chair with a base frame 10. Typically, this base frame is made of wood. While not shown, a supporting material is connected across the base frame 10 to support a coil assembly 12. The supporting material is often a fabric stretched across the bottom of the frame and stapled in place. An exemplary coil assembly 12 is disclosed in U.S. Pat. No. 6,367,881, the disclosure of which is hereby incorporated by reference. This type of coil support is known as a pocketed-coil assembly or an encased coil assembly. An upholstered fabric 16 is used to cover the base and coil assembly to make the furniture more comfortable and attractive. After the coil assembly and upholstery are in place, a cushion 14 is placed over the coil assembly to complete the construction. As stated above, the chair shown in FIG. 1 has a hard-edge construction. In this hard-edge construction the coil assembly 12 extends nearly all the way to the front rail of the frame 10. Moreover, in such a construction, the top of the front rail is in the same plane as the top of the pocketed-coil assembly 12. In this construction, when an occupant is positioned over the chair front, the cushion 14 can "bottom out" on the front rail. The hard-edge construction offers a firm feel along the chair front. While the hard-edge construction is preferable to some people, a softer feel is preferable to others. A spring-edge provides this softer feel.

An example of the spring-edge construction utilizing a pocketed-coil assembly is shown in FIG. 2. This spring-edge construction is also disclosed in U.S. Pat. No. 6,367,881. In a spring-edge construction, the front rail top is not in the same plane as the coil assembly top. Instead, the front rail top is midway up the height of the coil assembly. As seen in FIG. 2, a front-spring row 18 is then located on top of the rail and is attached to both the rail and to the pocketed-coil assembly. This front-spring row 18 is shown using a shorter pocketed coil.

When a spring-edge construction is used along with the pocketed-coil assembly, as shown in FIG. 2, several problems are presented. First, the additional row of shorter pocketed coils is installed by attaching the front row of pocketed coils to the pocketed-coil assembly with hog rings. The lower edge of each front coil is then stapled to the front rail. Then, an upper-border wire is attached to the upper, front edge of the front pocketed-coil row. This installation process is time consuming. Second, the stiffness of the front edge is difficult to adjust. Basically, the stiffness of the front edge is determined by the front pocketed-coil row. Third, it has been found that the front pocketed-coil row can interact undesirably with the pocketed-coil assembly when both are compressed. This interaction often results in a clicking feel as the coils of the front row come in contact with, and then quickly separate from, the coils in the pocketed-coil assembly. Along with the clicking feel, the interaction causes noise. Both of these conditions are undesirable.

A new spring-edge furniture construction is needed that offers the furniture fabricator a simple installation method. In addition, the new spring-edge furniture construction should avoid any coil-to-coil contact. Finally, it would be desirable to allow the furniture fabricator to specify or change the stiffness of the front spring-edge construction.

BRIEF SUMMARY OF THE INVENTION

A novel support for use with furniture having a spring-edge is provided that includes a coil assembly. The coil assembly is typically square or rectangular with top and bottom surfaces and a front edge that faces the front of the furniture piece. A bridge is secured to the top surface of the coil assembly to provide support for the spring-edge. The bridge extends outwardly away from the front edge of the coil assembly and is supported in the same plane as the top surface of the coil assembly by a series of wires. The wire supports terminate at and hold a stiffening member in place that forms the upper portion of the spring-edge. The stiffening member is used to attach a series of front springs to the bridge. These springs are held in place on their lower end by the frame of the piece of furniture. The bridge allows a spring-edge construction where the front springs are spaced away from the coil assembly, so that any potential for noise is eliminated. Moreover, the front springs can be varied in shape, spacing and material to tune the stiffness of the spring-edge.

Additional advantages and novel features of the invention will be set forth in the description which follows, and in part will become apparent to those skilled in the art upon examination of the following, or may be learned from practice of the invention.

BRIEF DESCRIPTION OF THE SEVERAL VIEWS OF THE DRAWINGS

The present invention is described in detail below with reference to the attached drawing figures, wherein:

FIG. 5 is view similar to FIG. 4, showing an alternate front spring construction;

FIG. 6 is a view similar to FIGS. 3 through 5, showing the bridge construction in a finished phase, again shown without the upholstery for clarity;

DETAILED DESCRIPTION OF THE INVENTION

Figure 1:
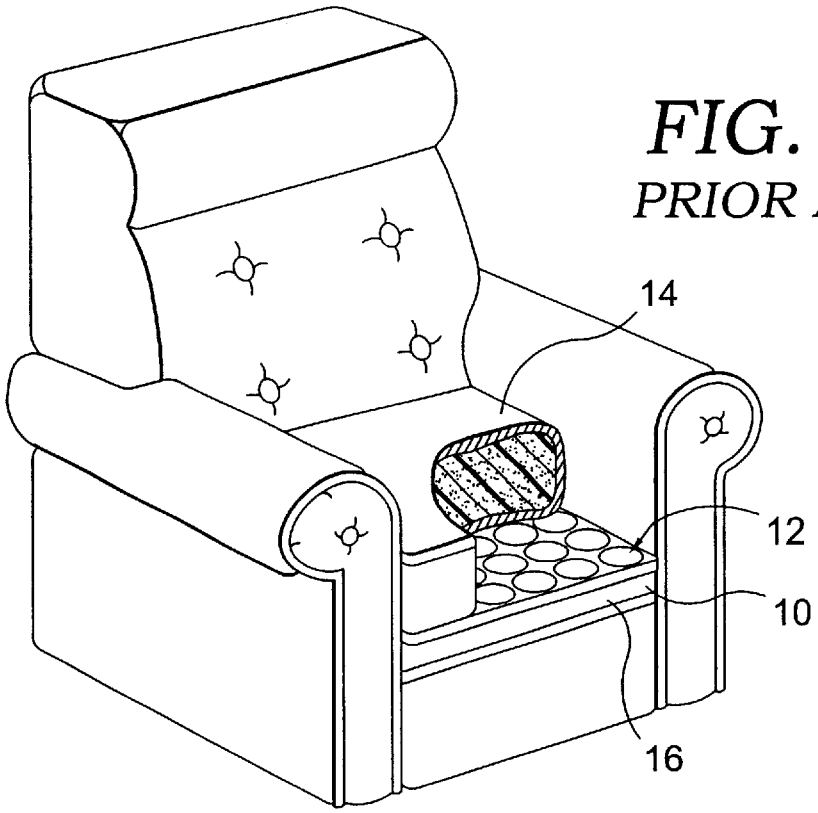
FIG. 1. PRIOR ART
FIG. 1 is a perspective view of a prior art chair, including a coil spring assembly constructed with a hard-edge construction.
Figure 2:
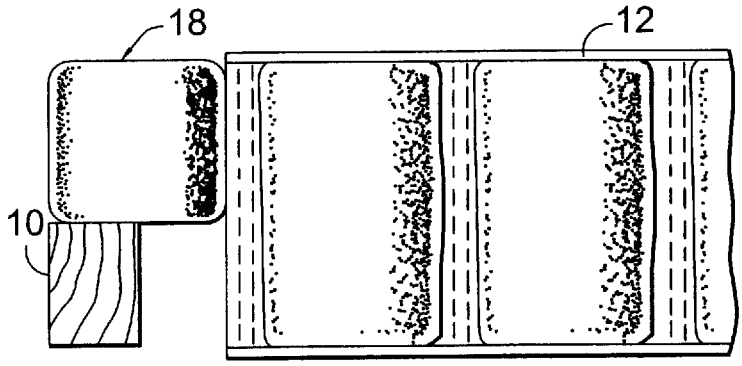
FIG. 2. PRIOR ART
FIG. 2 is a fragmentary, side elevational view of a prior art coil seating assembly having a spring-edge construction.
Figure 3:
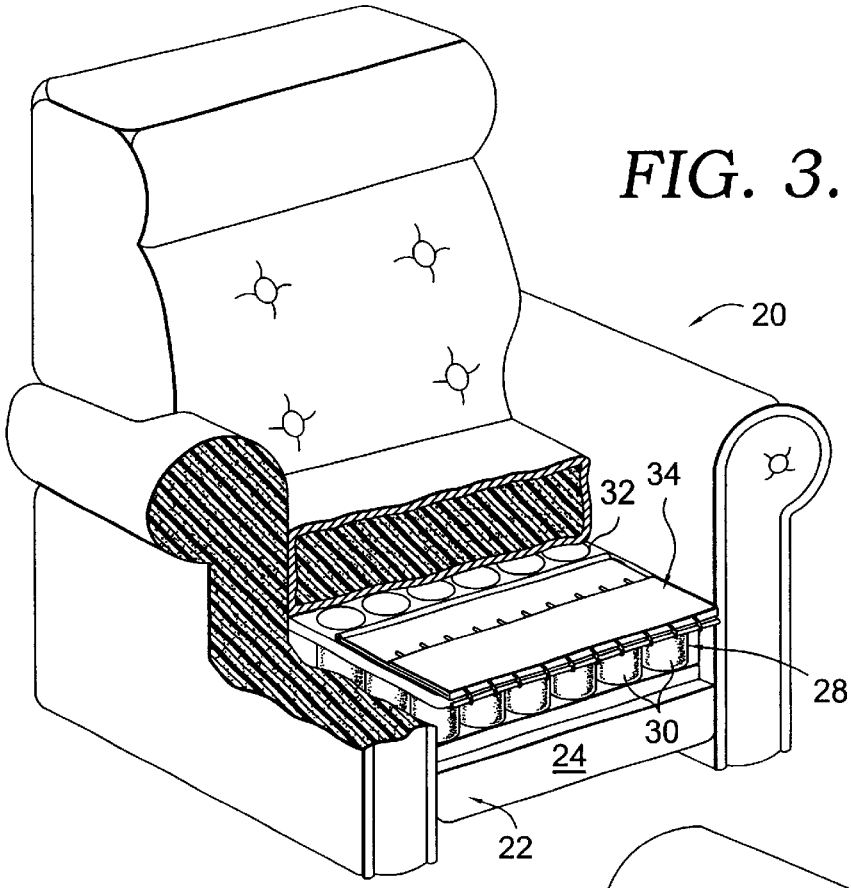
FIG. 3 is a view of a chair, with parts broken away and showing a bridge construction attached to the pocketed-coil assembly without the front row of springs installed.

A partial view of a chair 20 having the novel spring-edge construction is described with initial reference to FIG. 3. While the invention is described below with reference to a chair, it should be understood that the invention is applicable to many other types of furniture, such as sofas or loveseats. The chair 20 has a frame 22, including a front rail 24. The front rail 24 of the chair frame 22 is preferably approximately three inches high to allow for a front row of springs, as further described below. Typically, the frame 22 and the front rail 24 are made of wood. However, other materials could be used and are within the scope of the present invention. The frame 22 is constructed in the same manner as other chairs with a spring-edge construction.

Figure 8:
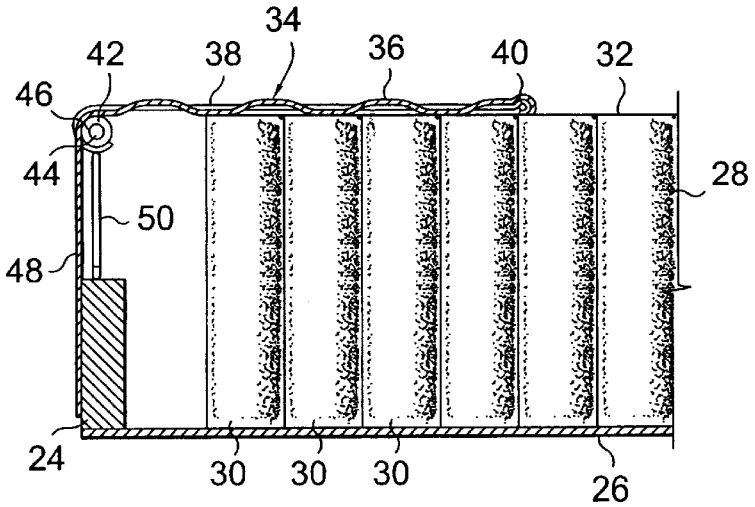
FIG. 8 is a partial cross-sectional view similar to FIG. 2, shown with the invention installed.

As best seen in FIG. 8, the frame 22 supports a fabric base 26. Preferably, the fabric 26 stretches across the bottom opening formed by frame 22, and staples attach the fabric 26 to the frame 22. In a preferred embodiment, the fabric 26 is a material known as PROPEX. Other fabrics and base materials are also acceptable for use in the practice of the present invention. The fabric 26 provides support for an encased coil assembly 28. The encased coil system is also known in the art as a pocketed-coil assembly. Leggett & Platt, Incorporated, of Carthage, Mo., sells a suitable encased coil system under the name SOFT LUXE. The encased coil system is also disclosed in U.S. Pat. No. 6,367,881, the specification of which is incorporated by reference. Broadly stated, the encased coil system 28 includes a series of rows of pocketed coils 30. An adhesive couples a covering sheet 32 to the top and bottom of encased coil system 28. The encased coil system 28 is preferably installed by adhesively securing the encased coil system 28 to the fabric base 26. As best seen in FIG. 8, the encased coil system 28 is installed so that the front edge is spaced rearwardly from the front rail 24.

Figure 7:
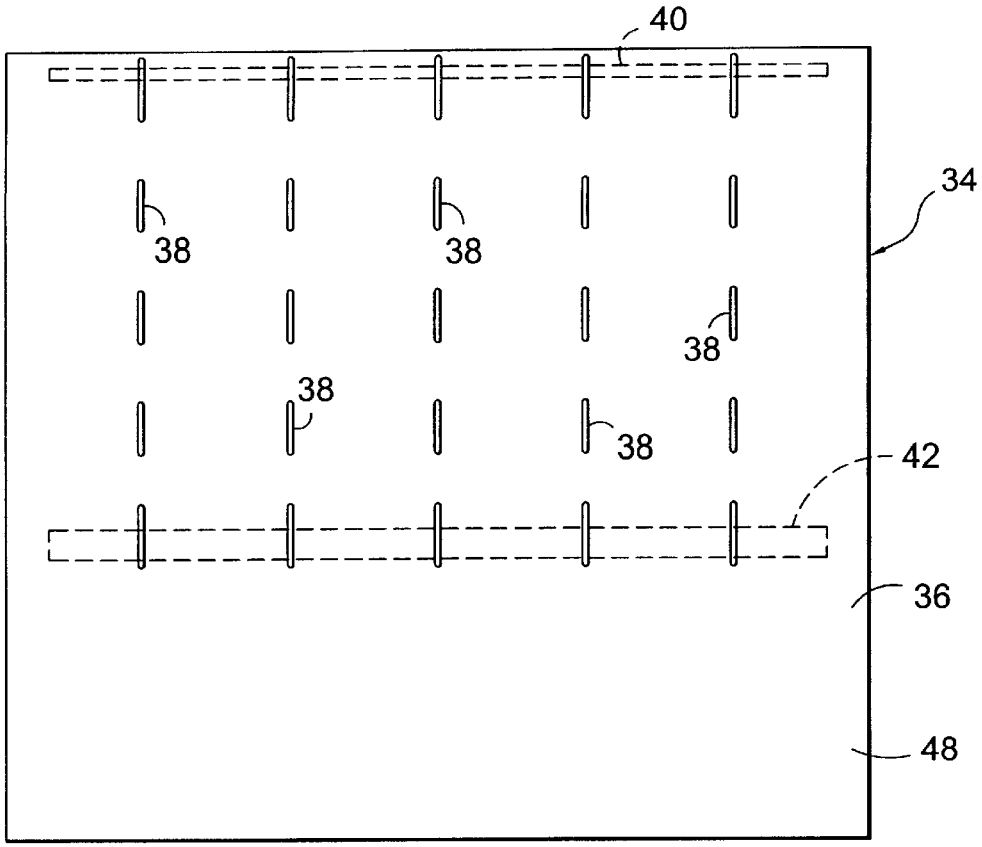
FIG. 7 is a top plan view of the bridge separate from the chair.

A bridge 34 provides a forward extension of the top of the encased coil system 28. An adhesive secures bridge 34 to the encased coil system 28. As best seen in FIG. 7, bridge 34 includes a spun bonded polypropylene sheet 36. The sheet 36 holds a series of wires 38. As one example, the wires 38 are woven into the sheet 36. In a preferred embodiment, wires 38 are oil-tempered spring steel. It should be understood that other wire material that provides a similar degree of stiffness is also acceptable and that other material is acceptable for sheet 36. A paper rope 40 secures one end of wires 38 in place on sheet 36. The paper rope 40 is located between the sheet 36 and the encased coil system 28 when the bridge is secured to the coil system. A paper-covered wire 42 is secured to the other end of wires 38. As best seen in FIG. 8, this paper covered wire 42 is preferably one that has a 12-gauge wire core 44 that is covered by a paper material 46. The paper covering 46 is similar to the paper rope 40. Thus, wires 38 hold the paper-covered wire 42 in place. As best seen in FIG. 7, a certain amount of sheet 36 overhangs the paper covered wire 42. This overhang 48 is used to provide a covering surface, as is further described below.

In use, the bridge 34 is glued to the top of the encased coil system 28. The bridge 34 is positioned so that the paper covered wire 42 extends in generally the same plane as the edge of the front rail 24 of the chair frame 22, as best seen in FIG. 8. The bridge 34 can be installed prior to shipping the encased coil system 28, or can be installed by a furniture fabricator at a later point in time.

Figure 4:
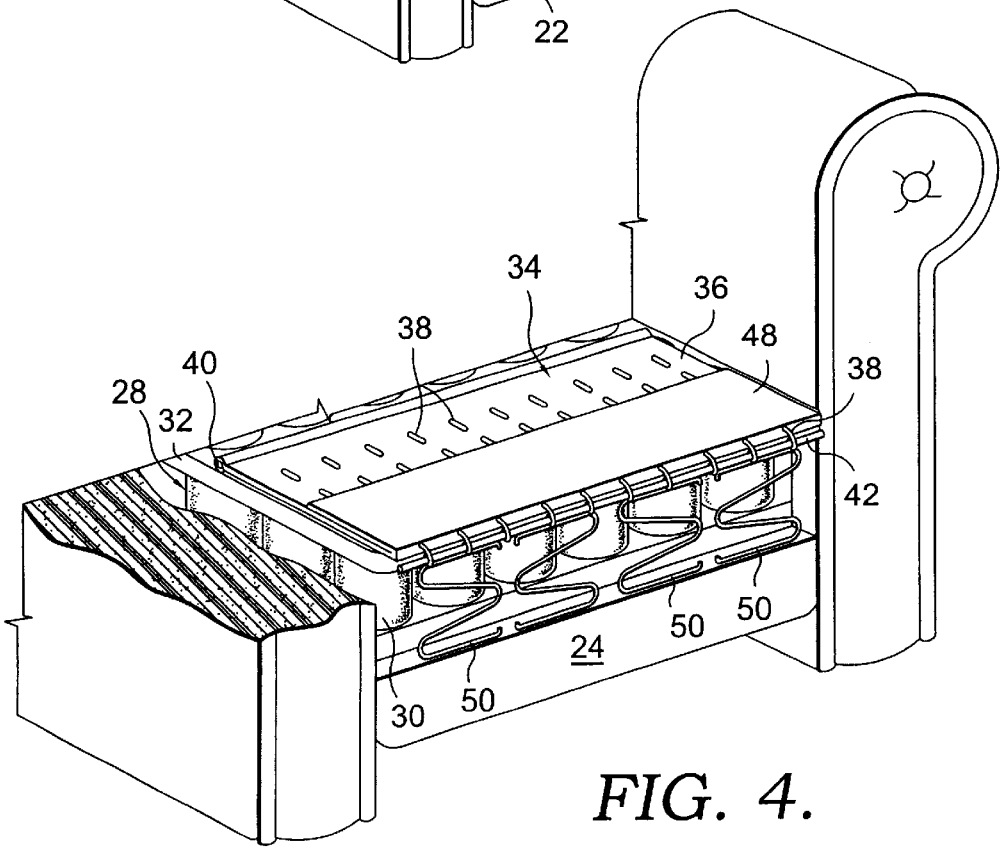
FIG. 4 is a view similar to FIG. 3, showing one example of a front row of springs installed along with the bridge.
Figure 9:
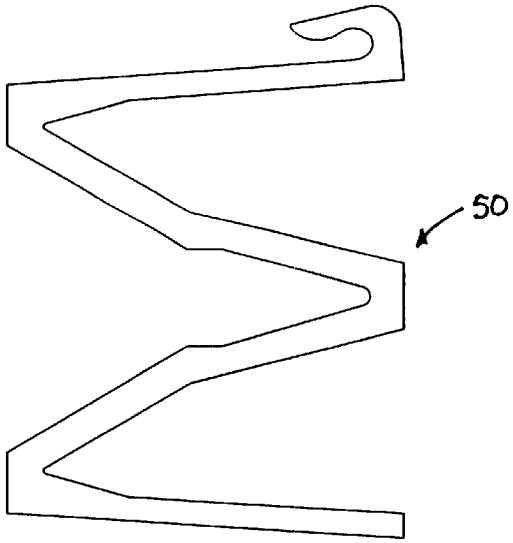
FIG. 9 is a side elevational view of an alternate spring construction suitable for use in the invention.
Figure 10:
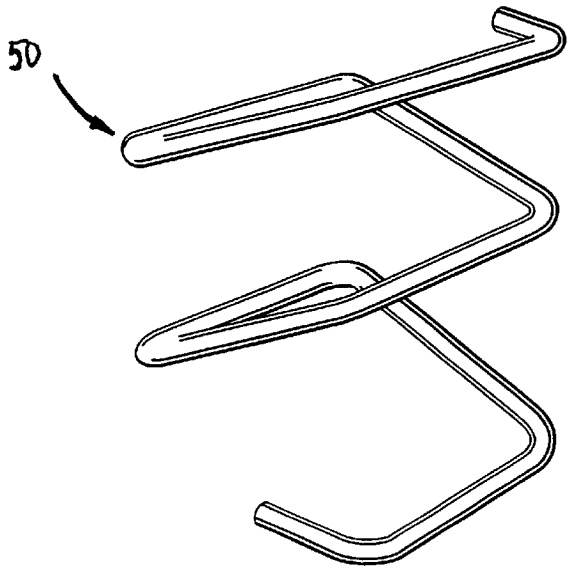
FIG. 10 is a perspective view of an alternate spring construction suitable for use in the invention.

Once the bridge 34 and the encased coil system 28 are installed, a series of front springs 50 are positioned between the top of the front rail 24 and the paper covered wire 42, as best seen in FIGS. 4 and 5. The springs 50 can be any of a number of different constructions. FIGS. 4 and 5 show two different acceptable constructions of springs 50. Importantly, the construction of the spring 50 is virtually unlimited in the practice of the invention, including using springs made from a variety of materials. Depending upon the desired stiffness of the spring-edge, varying spring designs can be used. In this way, the stiffness of the spring-edge can be tuned to the desires of the furniture fabricator, and ultimately the consumer. To install the front springs 50, the springs are attached on the top end to the paper covered wire 42 and on the bottom end to the front rail 24 of the chair frame 22. As one example, the front springs 50 can be fastened to the paper covered wire 42 with a metal clip and can be stapled to the front rail 24. FIG. 9 shows an additional spring construction 50. In this construction, spring 50 is made from a plastic material and has an integral spring clip incorporated on the top thereof. FIG. 10 shows yet another spring construction 50. In this construction, spring 50 is made from a wire material, bent in a square spiral configuration as shown. This construction is currently preferred. As stated above, other spring constructions are suitable in practicing the invention.

As best seen in FIG. 6, once the front springs 50 are in place, the overhang 48 of the sheet 36 is fastened to the front surface of front rail 24, such as by stapling or through use of an adhesive. Any other suitable attaching mechanism could also be used. At this stage, the chair can be upholstered, as is known to those of skill in the art. To finish the chair after upholstery, a cushion is placed on top of the upholstered surface and supported by the top of the encased coil system 28 and the bridge 34. Such a construction allows the front edge, formed by wire 42 and springs 50, to "give" forming a spring-edge. In this novel spring-edge construction, a pocketed-coil assembly 28 can be used for the main portion of the support for the cushion. Any potential for coil-to-coil noise is eliminated by the spacing achieved between the end of the encased coil system 28 and the front springs 50. This noise elimination is accomplished without the need for an unsupported gap between the front springs 50 and the encased coil system 28. Support is provided to the bridge 34 by the spring steel wires 38 and the paper covered wire 46. As stated above, the stiffness of the front edge can be "tuned" by the customer to achieve the desired stiffness. This tuning can be accomplished by varying the spacing of the springs and varying the spring construction itself.

The present invention has been described in relation to particular embodiments, which are intended in all respects to be illustrative rather than restrictive. Alternative embodiments will become apparent to those skilled in the art to which the present invention pertains without departing from its scope.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated and within the scope of the claims.

What is claimed is:

1. A seating assembly for use on a chair having a spring-edge construction, comprising:

a coil assembly having top and bottom surfaces, and at least a front edge defined between the top and bottom surfaces;

a bridge assembly secured to the top surface of the coil assembly, the bridge including a material sheet having wires woven therein that extend outwardly from the front surface of the coil assembly, the wires being coupled along a front edge thereof to a stiffening member; and a plurality of front springs attached to the stiffening member and extending downwardly therefrom wherein the front springs are bent in a square spiral configuration.

2. The seating assembly of claim 1, wherein the springs are clipped to the stiffening member.

3. The seating assembly of claim 2, wherein the stiffening member is a wire covered with paper.

4. The seating assembly of claim 3, wherein the wires woven through the material sheet are spring-steel wires.

5. The seating assembly of claim 4, wherein the material sheet extends beyond the stiffening member and over the front springs.

6. The seating assembly of claim 5, wherein the springs are spaced outwardly from the front edge of the coil assembly.

7. A chair having a spring-edge construction, comprising:

a base frame having at least a bottom and a front rail;

a support surface coupled to the bottom of the base frame;

a coil system secured to the support surface;

a bridge secured to the top of the coil system, the bridge including a material sheet having wires woven therethrough, the wires extending forwardly of the coil system and terminating at a stiffening member, the stiffening member being held outwardly from the front edge of the coil system by the wires; and a plurality of springs coupled between the stiffening member and the frame of the chair, wherein the springs are spaced from the front edge of the coil system and bent in a square spiral configuration.

8. The chair of claim 7, wherein the stiffening member is a paper covered wire.

9. The chair of claim 7, wherein the material sheet extends beyond the stiffening member, and wherein the extending portion of the material sheet is secured to the base frame to hide the springs.

10. The chair of claim 7, wherein the front springs are made of a steel wire material.

* * * * *